US006908543B1

(12) United States Patent
Moore, Jr.

(10) Patent No.: US 6,908,543 B1
(45) Date of Patent: Jun. 21, 2005

(54) METHOD FOR RETARDING FOULING OF FEED HEATERS IN REFINERY PROCESSING

(75) Inventor: Richard O. Moore, Jr., San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/694,554

(22) Filed: Oct. 23, 2000

(51) Int. Cl.[7] ..... C01G 45/00; C01G 45/72

(52) U.S. Cl. ..... 208/48 R; 208/142; 208/950; 585/258; 585/950

(58) Field of Search ..... 208/48 R, 142, 208/950; 585/258, 950

(56) References Cited

U.S. PATENT DOCUMENTS

| | | | | | |
|---|---|---|---|---|---|
| 3,776,835 | A | | 12/1973 | Dvoracek | |
| 3,852,207 | A | | 12/1974 | Stangeland et al. | |
| 3,904,513 | A | | 9/1975 | Pischer et al. | |
| 4,039,302 | A | | 8/1977 | Khera | |
| 4,042,614 | A | | 8/1977 | Vannice et al. | |
| 4,044,064 | A | * | 8/1977 | Milstein et al. | 260/676 R |
| 4,071,574 | A | * | 1/1978 | Milstein et al. | 260/676 R |
| 4,077,995 | A | | 3/1978 | Khera | |
| 4,080,397 | A | * | 3/1978 | Derr et al. | 208/79 |
| 4,088,671 | A | | 5/1978 | Kobylinski | |
| 4,151,190 | A | | 4/1979 | Murchison et al. | |
| 4,157,294 | A | | 6/1979 | Iwao et al. | |
| 4,171,320 | A | | 10/1979 | Vannice et al. | |
| 4,347,121 | A | | 8/1982 | Mayer et al. | |
| 4,351,803 | A | | 9/1982 | Olson | |
| 4,507,517 | A | | 3/1985 | Devries et al. | |
| 4,544,792 | A | | 10/1985 | Smith et al. | 58/533 |
| 4,599,474 | A | | 7/1986 | Devries et al. | |
| 4,704,487 | A | | 11/1987 | Devries et al. | |
| 4,704,493 | A | | 11/1987 | Devries et al. | |
| 4,709,108 | A | | 11/1987 | Devries et al. | |
| 4,734,537 | A | | 3/1988 | Devries et al. | |
| 4,810,357 | A | | 3/1989 | Chester et al. | |
| 4,814,533 | A | | 3/1989 | Devries et al. | |
| 4,814,534 | A | | 3/1989 | Devries et al. | |
| 4,814,538 | A | | 3/1989 | Devries et al. | |
| 5,190,634 | A | | 3/1993 | Fernandez-Baujin et al. | 208/107 |
| 5,362,378 | A | * | 11/1994 | Borghard et al. | 208/138 |
| 5,738,779 | A | * | 4/1998 | Dach et al. | 208/143 |
| 6,296,757 | B1 | * | 10/2001 | Wittenbrink et al. | 208/15 |

FOREIGN PATENT DOCUMENTS

| | | |
|---|---|---|
| DE | 155525 | 6/1982 |
| EP | 0207502 A2 | 1/1987 |
| EP | 0583836 A1 | 2/1994 |
| EP | 0609079 A1 | 8/1994 |
| GB | 2 145 426 A | 8/1963 |

OTHER PUBLICATIONS

Article "Enhance Hydroprocessor Efficiency and Reliability", World Refining—Supplement to Mar. 2000, vol. 10, No. 2, pp. 12–15.

V. Kaiser, English translation abstract: Petrole et Techniques N. 406 58–61 (Jan.–Feb. 1997).

* cited by examiner

*Primary Examiner*—Walter D. Griffin
(74) *Attorney, Agent, or Firm*—Burns, Doane, Swecker & Mathis, L.L.P.

(57) ABSTRACT

A method of minimizing the formation of polymers and other heavy molecular weight products upon heating of a hydrocarbon stream in a hydroconversion process is described. Specifically, sufficient hydrogen-containing gas is added to the hydrocarbon stream before heating to reduce its fouling tendency. The hydrogen-containing gas is added in an amount less than about 500 standard Cubic Feet per Barrel (SCFB). preferably less than about 100 SCFB and more preferably less than about 50 SCFB.

16 Claims, 1 Drawing Sheet

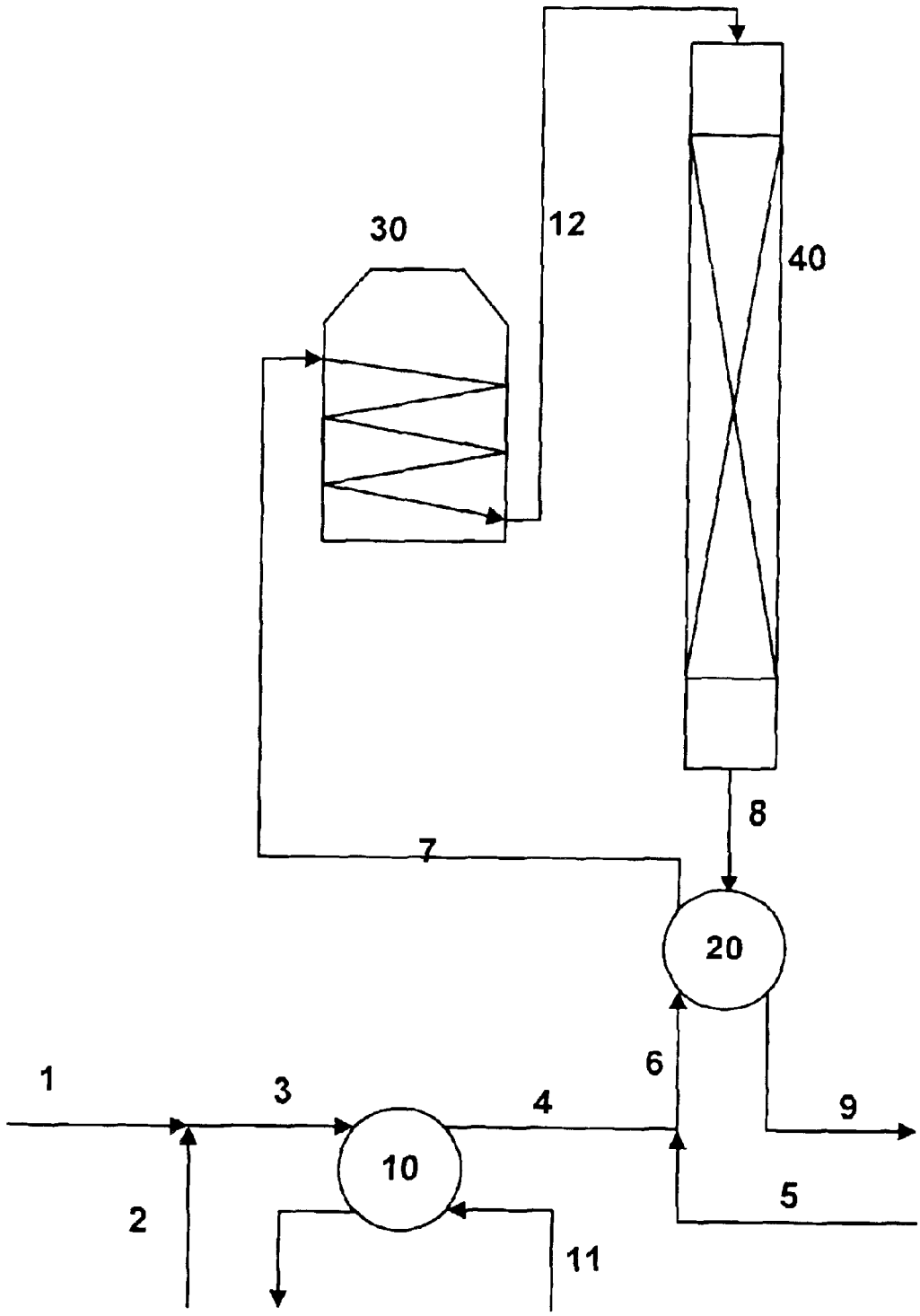
30
12
40
8
7
20
6
1
3
4
9
10
5
2
11

METHOD FOR RETARDING FOULING OF FEED HEATERS IN REFINERY PROCESSING

BACKGROUND OF THE INVENTION

The majority of combustible liquid fuel used in the world today is derived from crude oil. However, there are several limitations to using crude oil as a fuel source. For example, crude oil is in limited supply; it includes aromatic compounds believed to cause cancer; and contains sulfur and nitrogen-containing compounds that can adversely affect the environment, for example by producing acid rain.

Alternative sources for developing combustible liquid fuel are desirable. An abundant source is natural gas. Natural gas is often plentiful in regions that are uneconomical to develop because of a lack of local markets for the gas or the high cost of transporting the gas to remote markets. In such areas, the natural gas, which comprises mostly methane, is flared off rather than used, thus wasting the natural gas and adding undesirable combustion products to the atmosphere. An alternative is to convert the natural gas to a liquid fuel or other chemical product for local usage and more cost-effective transportation to remote markets.

The conversion of natural gas to combustible liquid fuel typically involves converting the natural gas, which is mostly methane, to synthesis gas, or syngas, which is a mixture of carbon monoxide and hydrogen. An advantage of using fuels prepared from syngas is that they typically do not contain nitrogen and sulfur and generally do not contain aromatic compounds. Accordingly, they have less health and environmental impact than conventional petroleum liquids based fuels.

Refining processes create materials which can foul process equipment, such as reactors and heaters. For example, Fischer-Tropsch chemistry is typically used to convert the syngas to a product stream that includes combustible liquid fuel, among other products. A feature associated with Fischer-Tropsch chemistry is that it produces a number of reactive species such as olefins and alcohols that, under certain conditions such as high temperatures, tend to form materials that will foul (adhere to) equipment surfaces, damaging or diminishing the effectiveness of heat exchangers, furnaces, catalytic reactors and the like. It is believed that some of the formed materials are polymers or other large molecules. Polymerization of olefins is known to occur where crude-oil derived hydrocarbons are exposed to oxygen-containing environments such as in storage tanks, and are then heated in a typical hydroprocessing plant to near reaction temperatures. For example, naphtha derived from refinery coking operations tends to form these products. While not wishing to be bound by theory. Fischer-Tropsch products are believed to behave similarly when heated because of the presence of olefins and oxygen-containing compounds, even without exposure to further oxygen sources.

Equipment fouling is known to be mitigated by stripping the hydrocarbon feed stream with hydrogen or fuel gas, primarily to remove oxygen. However, when the oxygen is in the form of alcohols rather than as oxygen gas, as is the case with Fischer-Tropsch products, the oxygen cannot be removed by feed stripping.

Sacrificial guard beds have been employed upstream of main catalytic reactors to collect polymerized products before passage through and, thus, fouling of heat exchangers, furnaces and other equipment. However, the use of such guard beds increases manufacturing costs significantly. In addition, such guard beds may not always be effective in prevention of heat exchange surface fouling.

It is also known to pre-heat hydrocarbon feeds to hydroprocessing reactors in shell and tube heat exchangers using the reactor effluent. Both the hydrocarbon feed (usually in the form of a pumpable liquid) and a large quantity of hydrogen-rich gas (e.g. greater than 750 Standard Cubic Feet per Barrel (SCFB)) are combined before entering the heat exchanger. In this case, the hydrogen-rich gas acts as a velocity-maintaining agent (usually on the tube-side of the exchanger) to avoid the deposition of particulate matter in the feed, thus preventing fouling of the heat exchangers and other equipment in the feed pre-heat train.

It would be advantageous to provide additional means of protecting pre-heat equipment that handles, for example, Fischer-Tropsch synthesis and refinery coking products, which minimizes the formation of fouling products. The present invention provides such methods.

SUMMARY OF THE INVENTION

The present invention is directed at a process for retarding fouling in a refinery process. Additionally, the invention in particular relates to an integrated process for producing liquid fuels from a hydrocarbon stream provided by Fischer-Tropsch synthesis, refinery coking operations or other processes. Hydrocarbon streams that include reactive oxygenate species such as alcohols and/or hydrocarbon unsaturates such as olefins and aromatics tend to have fouling problems. The process minimizes the formation of polymers and other heavy molecular weight products from the hydrocarbon streams upon heating.

In the particularly preferred process described herein. Fischer-Tropsch synthesis or refinery coking operations are performed to produce a hydrocarbon stream containing reactive species, including olefins and alcohols, for formation of useable products such as combustible liquid fuel or lubricating base stocks by a hydroconversion process. A stream of hydrogen-containing gas sufficient to retard the polymerization of the reactive species and present fouling of the pre-heat and other processing equipment is added to the hydrocarbon stream before pre-heating upstream of a hydroprocessing reactor. The treated hydrocarbon stream is then pre-heated and processed as known in the art.

In one embodiment, Fischer-Tropsch products are recovered as at least a low-boiling, fraction containing oxygenate and olefin components, and a high-boiling fraction such as a wax-containing stream, wherein hydrogen-containing gas is added to the light product stream before further treatment to prevent fouling of at least a pre-heat exchanger.

The hydrogen-containing gas stream can be used as a reactant with a Fischer-Tropsch hydrocarbon product stream, preferably the low-boiling fraction, to prevent fouling of processing equipment, and may be added in relatively small quantities to the hydrocarbon product stream, and thus does not significantly impact the size and cost of the processing equipment required. Sufficient hydrogen-containing gas is added to reduce the fouling tendency of the hydrocarbon product stream, typically less than about 500 SCFB, preferably less than about 100 SCFB and more preferably less than about 50 SCFB.

The hydrocarbon product stream useful in the Fischer-Tropsch embodiment of the invention can contain about 0.5 wt % or more of normal alcohols that boil in the range of from about 50° C. to about 350° C. The hydrocarbon product stream can also contain about 5 wt % or more of mono-olefins that boil in the range of from about 105° C. to about 350° C. Although not limited to Fischer-Tropsch processes, preferably the hydrocarbon product stream is derived from a Fischer-Tropsch process, and most preferably is a Fischer-Tropsch low-boiling fraction boiling in the range of from about −65° C. to about 350° C.

BRIEF DESCRIPTION OF THE DRAWING

The FIGURE is an illustrative schematic flow diagram representing one preferred embodiment of the invention, but the invention is applicable to all appropriate refinery and/or chemical processing.

DETAILED DESCRIPTION OF THE INVENTION

The present invention is directed to an integrated process for minimizing the formation of polymers and other heavy molecular weight products from reactive oxygenate and unsaturate hydrocarbon species such as alcohols, olefins and aromatics often present in hydrocarbon streams used as feedstock for hydroprocessing plants. A preferred embodiment is used with the hydrocarbon product stream from Fischer-Tropsch synthesis, refinery coking operations, and fluid catalytic cracking (FCC) operations, among others. As used herein, the term "integrated process" refers to a process comprising a sequence of steps, some of which may be performed in parallel, but all of which are interrelated or somehow dependent upon either earlier or later steps in the process.

The process involves adding a hydrogen-containing gas stream to a hydrocarbon stream before heating or other processing in order to minimize the formation of polymers and other heavy molecular weight products from reactive species such as alcohols, olefins and aromatics present in the hydrocarbon stream. This process prevents or minimizes fouling of processing equipment, in particular heat exchangers and furnaces, such as might be used in a hydroprocessing plant.

Hydroprocessing, or hydroconversion, can include one or more of hydrofining, hydrotreating and hydrocracking. In hydroconversion, hydrogen is reacted with a hydrocarbon on the surface of a catalyst, usually at high heat and/or under pressure, to produce a higher grade hydrocarbon, in particular a combustible liquid fuel, lubrication oil base stock or other useful chemical product. There is no distinct division between the hydroconversion processes. Hydrofining is usually a mild hydroconversion process. Hydrotreating may include hydrofining and includes desulfurization and denitrification of hydrocarbon feeds. Hydrocracking generally refers to breaking down the high molecular weight components of hydrocarbon feed to form other, lower molecular weight products.

Synthesis Gas

Synthesis gas (syngas) typically comprises hydrogen and carbon monoxide, and may include minor amounts of carbon dioxide and/or water. It can be obtained by processes known in the art from natural gas, byproducts of hydroprocessing, or mixtures thereof. It may also be generated from coal, petroleum coke, heavy oils and other hydrocarbon feed sources. Preferably, the ratio of hydrogen to carbon monoxide in the resultant syngas is greater than 1.0 in order to minimize the amount of oxygenated products formed in the Fischer-Tropsch reaction.

Fischer-Tropsch Chemistry

Syngas is converted to a hydrocarbon product stream by contact with a Fischer-Tropsch catalyst under reactive conditions in Fischer-Tropsch synthesis, as known to practitioners in the art. Depending on the quality of the syngas feedstock, it may be desirable to purify the syngas prior to the Fischer-Tropsch reaction to remove carbon dioxide and any contaminants, such as sulfur and nitrogen containing compounds.

Examples of conditions for performing Fischer-Tropsch reactions are well known to practitioners in the art. Suitable conditions are described, for example, in U.S. Pat. Nos. 4,704,487; 4,507,517; 4,599,474; 4,704,493; 4,709,108; 4,734,537. 4,814,533; 4,814,534 and 4,814,538, the contents of each of which are hereby incorporated by reference in their entirety for all purposes. A particularly preferred Fischer-Tropsch process is taught in EP0609079, also completed incorporated herein by reference for all purposes.

The Fischer-Tropsch reaction may be effected in a fixed bed, in a slurry bed, or in a fluidized bed reactor. The Fischer-Tropsch reaction conditions may include utilizing a reaction temperature of between 190° C. and 340° C. with the actual reaction temperatures being largely determined by the reactor configuration.

An inlet synthesis gas pressure to the Fischer-Tropsch reactor of between 1 and 50 bar, preferably between 15 and 50 bar, may be used. The synthesis gas may have a H2:CO molar ratio, in the fresh feed, of 1.5:12 to 2.5:1, preferably 1.8:1 to 2.2:1. A space velocity, in $m^3(kg\ catalyst)^{-1}\ hour^{-1}$, of from 1 to 20, preferably from 8 to 12, may be utilized in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may comprise iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron based catalyst may contain various levels of promoters, the role of which may be to alter one or more of the activity, the stability and the selectivity of the final catalyst. Preferred promoters are those influencing the surface area of the reduced iron ("structural promoters") and these include oxides of metals of Mn, Ti, Mg, Cr, Ca, Si, Al or Cu or combinations thereof.

Suitable catalysts include those described in U.S. Pat. Nos. 4,077,995; 4,039,302; 4,151,190; 4,088,671; 4,042,614 and 4,171,320. U.S. Pat. No. 4,077,995 discloses a catalyst that includes a sulfided mixture of CoO. $Al_2O_3$ and ZnO. U.S. Pat. No. 4,039,302 discloses a mixture of the oxides of Co. Al. Zn and Mo. U.S. Pat. No. 4,151,190 discloses a metal oxide or sulfide of Mo. W. Re. Ru. Ni or Pt, plus an alkali or alkaline earth metal, with Mo-K on carbon being preferred.

The invention's use in the preferred Fischer-Tropsch embodiment reaction of either a low or moderate chain growth catalyst or a high chain growth catalyst produces reactive products such as alcohols, other oxygenates and olefins, and generally unreactive paraffins. While not wishing to be bound by theory, it is believed the olefins combine to form larger, heavy molecular weight products such as polymers when heated to elevated temperatures such as, for example, during hydroprocessing or hydrocracking operations. The polymers and/or heavy molecular weight products may deposit in heat exchangers and other processing equipment, fouling the equipment. The present invention minimizes or alleviates this problem.

Although the formation of hydrocarbons from syngas is described herein in terms of a Fischer-Tropsch reaction, the reaction can optionally be performed using various modifications of the literal Fischer-Tropsch process where hydrogen (or water) and carbon monoxide (or carbon dioxide) are converted to hydrocarbons (e.g. paraffins, ethers, and the like). Thus, the terms "Fischer-Tropsch product," "Fischer-Tropsch process" and "Fischer-Tropsch reaction" and the like are intended to apply to Fischer-Tropsch products and processes and the products formed by various modifications thereof. For example, these terms are intended to apply to the Kolbel-Engelhardt process typically described by the reaction:

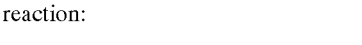

$$3CO+H_2O \rightarrow —CH_2— + 2CO_2$$

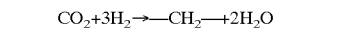

$$CO_2+3H_2 \rightarrow —CH_2— + 2H_2O$$

and the resultant products. As with Fischer-Tropsch reactions, the $CO_2$ product can be returned to the syngas generator and combined with methane (and some air) to form additional syngas.

The Separation of Fischer-Tropsch Reaction Products

After the Fischer-Tropsch synthesis, $C_{5+}$ hydrocarbons may be divided into two product streams comprising at least one low-boiling fraction (generally in the $C_{5-20}$ range), primarily used to form combustible liquid fuels, and a high-boiling fraction such as a wax ($C_{20+}$). The high-boiling fraction, e.g. the wax fraction, can either be used directly, or can be reacted to form lubricant base oils or lower molecular weight products, as desired. For example, the high-boiling wax fraction can be hydrocracked to provide lower molecular weight products, such as combustible liquid fuels.

Treatment of the Lighter Fraction Prior to Hydroconversion

The lighter fraction typically comprises a mixture of hydrocarbons, including mono-olefins and alcohols. The mono-olefins are present in an amount of at least about 5.0 wt % of the lighter fraction, preferably at least about 15.0 wt % of the lighter fraction, and most preferably at least about 25.0 wt % of the lighter fraction. The mono-olefins boil at a temperature in the range of about −105° C. to about 350° C. The alcohols are present in an amount typically of at least about 0.5 wt % or more. The alcohols boil in a temperature range of about 50° C. to about 350° C. The lighter fraction typically boils at a temperature of from about −65° C. to about 350° C.

The lighter fraction may be processed separately, or combined with other streams, such as the heavier fraction, for further processing. The invention may be practiced either on the separate lighter fraction stream, or on a combined stream, or on any stream that may contain the reactive species described.

The lighter fraction is optionally fed into a surge drum to flash separate any remaining light gases and water. In preferred embodiments, the drum is designed and operated such that it is sufficient to remove the majority of light gases and water without significantly reducing the condensate fraction flow-through. The surge drum is preferably blanketed with fuel gas to prevent absorption of nitrogen or other ambient gases into the lighter fraction. The lighter fraction is then transmitted to a feed pump where it is pressurized. The feed pump preferably includes a minimum flow bypass to prevent loss of feed and a stop check valve system to prevent back-flow to the low pressure feed system.

After leaving the feed pump or pumps, the pressurized lighter fraction is mixed with a hydrogen-containing gas stream of the invention. This lighter fraction includes a relatively large proportion of olefins and some oxygenates, such as alcohols. It is desirable to remove the oxygenates, typically through hydrotreatment. While not wishing to be bound by theory, when the lighter fraction is heated for hydroconversion, the olefins and/or alcohols are believed to form heavy molecular weight products, such as polymers. These products can foul heat exchangers and other downstream equipment. While it is desirable to remove the high molecular weight products, it is more desirable to minimize or inhibit their formation.

Adding even a small amount of hydrogen-containing gas, typically less than about 500 SCFB of hydrogen, preferably less than about 100 SCFB, and more preferably less than about 50 SCFB, to the lighter fraction before it is heated and sent to the hydrotreater prevents or minimizes formation of the undesirable heavier molecular weight products. In particular, adding hydrogen helps prevent polymerization of the olefins and/or alcohols upon heating in the heat exchangers.

The source of hydrogen can be virtually any hydrogen-containing gas that does not include significant amounts of impurities that would adversely affect the hydroconversion catalysts. In particular, the hydrogen-containing gas comprises sufficient amounts of hydrogen to achieve the desired effect, and may comprise other gases that are not harmful to the formation of desired end products and that do not promote or accelerate fouling of the downstream catalysts and hydrotreatment equipment. A preferred hydrogen-containing gas contains greater than 70 mole % hydrogen and trace amounts of gaseous hydrocarbons and other impurities. Examples of possible hydrogen-containing gases include hydrogen gas, syngas (or a fraction thereof), the hydrogen from a hydrogen plant, recycle gas in a hydroprocessing unit and the like. Alternately, the hydrogen-containing gas may be a portion of the hydrogen used for hydrogenating the wax fraction.

After the hydrogen-containing gas is introduced into the lighter fraction, the combined stream is pre-heated, for example in a heat exchanger. The combined stream is typically heated to temperatures in the range of from about 120° C. to about 400° C.

Hydroconversion

Catalysts useful for hydroconversion of the low-boiling fraction and wax fraction are well known in the art. See, for example, U.S. Pat. Nos. 4,347,121 and 4,810,357 for general descriptions of hydroconversion catalysts and conditions. Suitable catalysts include noble metals from Group VIIIA, such as platinum or palladium on an alumina or siliceous matrix, and Group VIIIA and Group VIB metals, such as nickel, cobalt, molybdenum, tungsten or mixtures thereof on an alumina or siliceous matrix. U.S. Pat. No. 3,852,207 describes suitable noble metal catalysts and mild hydrotreating conditions. Other suitable catalysts are described, for example, in U.S. Pat. Nos. 4,157,294 and 3,904,513. The contents of these patents are hereby incorporated by reference.

The non-noble (such as nickel-molybdenum) hydrogenation metal is usually present in the final catalyst composition as an oxide or, more preferably, as a sulfide, when such compounds are readily formed from the particular metal involved. Preferred non-noble metal catalyst compositions contain in excess of about 5 weight percent, preferably about 5 to about 40 weight percent, molybdenum and/or tungsten, and at least about 0.5, preferably about 1 to about 15 weight percent of nickel and/or cobalt determined as the corresponding oxides. The noble metal (such as platinum) catalyst contains in excess of about 0.01 percent metal, preferably between about 0.1 and about 1.0 percent metal. Combinations of noble metals may also be used, such as mixtures of platinum and palladium.

In a preferred embodiment, the hydroconversion reactor includes a plurality of catalyst beds, wherein one or more beds may function to remove impurities such as any metals and other solids which may be present, one or more additional beds may function to crack or convert the feedstock, and one or more other beds may function to hydrotreat the oxygenates and olefins in the condensate and/or wax fraction.

The product from the hydroconversion reaction can be subject to distillation, catalytic isomerization and/or various additional process steps to provide lube oils, gasoline, diesel fuel, jet fuel and the like, as known to practitioners in the art.

In one embodiment, a first hydrogen-containing gas is added to a hydrocarbon stream in an amount sufficient to reduce the amount of heavy molecular weight products formed during heating as compared to a heated hydrocarbon stream without added hydrogen, to form a mixed stream. The mixed stream is heated, preferably to a temperature in the range of from about 120° C. to about 400° C., and a second hydrogen-containing gas is added to the heated mixed stream in an amount, preferably more than 750 SCFB, sufficient to effect hydroconversion of the mixed stream to form a hydroconversion feed stream. The hydroconversion feed stream is heated to the reaction temperature, preferably to a temperature in the range of 250° C. to about 400° C., and the hydroconversion feed stream is hydroconverted.

The process described herein will be readily understood by referring to the particularly preferred embodiment in the flow diagram in the accompanying Figure. In the Figure, the low-boiling fraction 1 from a Fischer-Tropsch reactor (not shown) is combined with a first hydrogen-containing gas 2 to form a mixed stream 3 and sent to a heat exchanger 10, where it comes into contact with a heating medium 11. Additional hydrogen-containing gas 5 is added to the heated mixed stream 4, and the resultant hydroconversion feed stream 6 is sent to a reactor feed/effluent heat exchanger 20. The resulting heated feed 7 is heated to reaction temperatures in furnace 30 and the reaction feedstock 12 is passed to a hydroconversion reactor 40. The product of the hydroconversion reaction 8 is sent back through the reactor feed/effluent heat exchanger 20, where it transfers its heat to the hydroconversion feed stream 6 and is thereby cooled. The reactor effluent 9 is then collected.

The methods of heating the hydrocarbon streams in the heat exchangers in the present process can include any methods known to practitioners in the art. For example, a shell and tube heat exchanger may be used, wherein a heated substance, such as steam or a reaction product from elsewhere in the process, is fed through an outer shell, providing heat to the stream in an inner tube, thus heating the stream and cooling the heated substance in the shell. Alternately, the hydrocarbon stream may be heated directly by passing through a heated tube, wherein the heat may be supplied by electricity, combustion, or any other source known to practitioners in the art.

Similarly, though a reactor feed/effluent heat exchanger is exemplified, the means of heating the hydroconversion feed stream may be any means known to practitioners in the art, including heat exchange or direct heating, as described above. The heat exchange may be performed using the heated effluent from the hydroconversion, other heated streams or steam, as known to practitioners in the art. Specific embodiments, especially with respect to Fischer-Tropsch, are described herein. However, practitioners in the art will recognize alternate materials, processes and operating parameters which may be used within the spirit of the above described invention. Such alternate materials, processes and operating parameters are meant to be included within the scope of the invention as set forth in the above description and the following claims. For example, the hydrogen addition process can be used in any chemical or refining process where fouling creates a problem.

What is claimed is:

1. A process for hydroconversion of a Fischer-Tropsch hydrocarbon stream including oxygenates and hydrocarbon unsaturates with reduction in formation of heavy molecular weight products during heating comprising at least one preheating step prior to a heating step for achieving hydroconversion reaction temperature, the process comprising:

a) adding a first hydrogen-containing gas to the hydrocarbon stream prior to the at least one preheating step and not under hydroconversion conditions, wherein the first hydrogen-containing gas is added in an amount less than about 100 SCFB and wherein the first hydrogen-containing gas is sufficient to reduce the amount of heavy molecular weight products formed during the preheating as compared to a heated hydrocarbon stream without added hydrogen, to form a mixed stream;

b) preheating the mixed stream;

c) adding a second hydrogen-containing gas to the preheated mixed stream sufficient to effect hydroconversion of the mixed stream, to form a hydroconversion feed stream;

d) heating the hydroconversion feed stream to reaction temperature; and e) hydroconverting the hydroconversion feed stream.

2. The process according to claim 1, wherein the oxygenates and unsaturates are selected from the group consisting of normal alcohols, mono-olefins, and mixtures thereof.

3. The process of claim 2, wherein the hydrocarbon stream comprises at least 0.5 wt % normal alcohols as oxygenates.

4. The process of claim 3, wherein the normal alcohols boil in the range of from about 50° C. to about 350° C.

5. The process of claim 2, wherein the hydrocarbon stream comprises at least about 5.0 wt % mono-olefins.

6. The process of claim 2, wherein the hydrocarbon stream comprises at least about 15.0 wt % mono-olefins.

7. The process of claim 2, wherein the hydrocarbon stream comprises at least about 25.0 wt % mono-olefins.

8. The process of claim 7, wherein the mono-olefins boil in the range of from about −105 to 350° C.

9. The process of claim 1, wherein the Fischer-Tropsch hydrocarbon stream is a low-boiling fraction in a range from about −65° C. to about 350° C.

10. The process of claim 1, wherein the first hydrogen-containing gas is from a hydrogen production unit.

11. The process of claim 1, wherein the first hydrogen-containing gas is recycled from a hydroprocessing operation.

12. The process of claim 1, wherein the first hydrogen-containing gas is syngas.

13. The process of claim 1, wherein the first hydrogen-containing gas is added in an amount less than about 50 SCFB.

14. The process of claim 1, wherein the second hydrogen-containing gas is added in an amount more than 750 SCFB.

15. The process of claim 1, wherein the mixed stream is preheated to a temperature in the range of from about 120° C. to about 400° C.

16. The process of claim 1, wherein the mixed stream is preheated to a temperature in the range of from about 250° C. to about 400° C.

* * * * *